United States Patent [19]

Schick et al.

[11] 4,415,338

[45] Nov. 15, 1983

[54] AQUEOUS CARBONACEOUS SLURRIES

[75] Inventors: Martin J. Schick, New York, N.Y.; Kathy A. Knitter, San Francisco, Calif.

[73] Assignee: Diamond Shamrock Corporation, Dallas, Tex.

[21] Appl. No.: 387,176

[22] Filed: Jun. 10, 1982

[51] Int. Cl.[3] ..... C10L 1/32

[52] U.S. Cl. ..... 44/51; 44/62; 406/47; 406/49; 406/197; 252/353; 252/355

[58] Field of Search ..... 44/51, 62; 406/47, 49, 406/197; 252/353, 355

[56] References Cited

U.S. PATENT DOCUMENTS

| | | | |
|---|---|---|---|
| 4,195,975 | 4/1980 | Hamuro et al. | 252/356 |
| 4,242,098 | 12/1980 | Braun et al. | 44/51 |
| 4,282,006 | 8/1981 | Funk | 44/51 |
| 4,330,301 | 5/1982 | Yamamura et al. | 44/51 |

FOREIGN PATENT DOCUMENTS

| | | | |
|---|---|---|---|
| 378383 | 8/1932 | United Kingdom | 252/353 |

*Primary Examiner*—Charles F. Warren
*Assistant Examiner*—Margaret B. Medley
*Attorney, Agent, or Firm*—Neal T. Levin

[57] ABSTRACT

Aqueous carbonaceous slurries having reduced viscosity, a stabilized network of coal in water and improved pumpability are obtained by having present a salt of naphthalenesulfonic acid formaldehyde condensate and at least one water soluble polymer selected from the group consisting of gum karaya, mixtures of gum karaya and polyacrylamide and polysaccaride modified with polyacrylate. For example, a mixture of 61.5% by weight of ammonium naphthalenesulfonic acid formaldehyde condensate and 38.5% by weight of gum karaya can be added to an aqueous coal slurry in an amount of 0.13% by weight of the slurry.

23 Claims, No Drawings

AQUEOUS CARBONACEOUS SLURRIES

BACKGROUND OF THE INVENTION

1. Field of the Invention

This invention relates to aqueous carbonaceous slurries and more particularly to aqueous coal slurries stabilized with water soluble polymers.

2. Description of the Prior Art

Transport is one of the major problems involved in use of particulate carbonaceous materials such as coal. One method of transport involves aqueous slurries. However, aqueous slurries of finely ground coal containing over 55 weight percent solids are difficult to pump with slurry pumps. This is because as the solids level is increased above 50 weight percent, water and solids tend to separate causing coal particles to build up in various areas in the pumping system. This dewatering of the slurry causes blockage and jamming in the pumping system.

On the other hand, decreasing the weight percent of water in aqueous coal slurries is desirable because water is a major contributor to the cost of transport and processing operations. The less water transported the greater the volume of coal that can be moved, resulting in transport efficiencies. Further, water resources are limited. Also, during burning of coal, a significant amount of heat is required to vaporize the water. As the weight percent of water decreases, the efficiency of the coal burning process increases. Hence, use of higher weight percent solids aqueous carbonaceous slurries than were heretofore feasible would be of great importance.

U.S. Pat. No. 4,242,098—Braun et al—Dec. 30, 1980, describes addition of particular water soluble polymers, viz., poly (ethylene oxide), partially hydrolyzed poly (acrylamide), hydroxyethyl cellulose, the quaternary nitrogen-substituted cellulose ethers, xanthan gum, hydroxypropyl guar gum and carboxymethyl hydroxypropyl guar gum to aqueous coal slurries to permit the extrusion, pumping and transport of aqueous coal slurries having higher solids content.

U.S. Pat. No. 4,282,006—Funk, Aug. 4, 1981, describes a pipeline pumpable coal water slurry having a high content of coal particles with a minimum of void spaces and a maximum of particle surface area to enhance dispersing effects generated by electrolytes and/or dispersing agents added to the slurry. For dispersing agents, see Column 29, line 53 to Column 31, line 9, including condensed mononaphthalene sulfonic acid and its sodium and ammonium salts (Column 30, Lines 19 and 20).

SUMMARY OF THE INVENTION

Improved stabilized aqueous carbonaceous slurries having reduced viscosity, a stabilized network of coal in water and improved pumpability are obtained by having present a mixture of (1) at least one dispersant selected from the group consisting of sodium, lithium, potassium and ammonium salts of naphthalenesulfonic acid formaldehyde condensate and (2) as a stabilizer, at least one water soluble polymer selected from the group consisting of gum karaya, mixtures of gum karaya and polyacrylamide and polysaccharide modified with polyacrylate, said mixture present in an amount sufficient to reduce viscosity of the slurry, stabilize the network of coal in water and improve pumpability. In some instances reduced formation and accumulation of sediment which is not dispersed solely by agitation occurs. In co-pending application Ser. No. 370,098—Fleming, et al filed Apr. 20, 1982 entitled, Water Slurries of Carbonaceous Materials, there is disclosed the use of metal salts including the sodium salt of naphthalenesulfonic acid formaldehyde condensate to reduce viscosity of the slurry and improve its pumpability and in copending application Ser. No. 377,412—Villa, filed May 12, 1982, entitled, Carbonaceous Materials In Water Slurries, there is disclosed the use of the ammonium salt of naphthalenesulfonic acid formaldehyde condensate to reduce the viscosity of aqueous carbonaceous slurries. It has been found that addition of at least one of the aforesaid water soluble polymers allows for a stabilized network of coal in water, reduces viscosity of the slurry and in some instances reduces formation and accumulation of sediment which is not dispersed solely by agitation.

DESCRIPTION OF THE PREFERRED EMBODIMENTS

The mixture of (1) at least one dispersant selected from the group consisting of the sodium, lithium, potassium and ammonium salts of naphthalenesulfonic acid formaldehyde condensate, the sodium and ammonium salts hereinafter referred to as sodium condensate and ammonium condensate, respectively, for convenience, and (2) aforesaid water soluble polymer is present in the slurry in amounts sufficient to reduce viscosity of the slurry, stabilize the network of coal in water and improve pumpability. In some instances, reduced formation and accumulation of sediment which is not dispersible solely by agitation occurs. For example from about 0.01% by weight to about 10.0% by weight of the mixture, based on the total weight of the slurry, i.e., solids plus water, can be used. The relative amounts of the two components in the mixture with respect to each other are from about 8% by weight to about 97% by weight of dispersant to from about 3% by weight to about 92% by weight of water soluble polymer. The resulting slurries will generally have about 60% by weight solids and about 40% by weight water.

The dispersant and water soluble polymer are introduced into the slurry in the following manner. Both components can be introduced together as a mixture or each component can be introduced separately. Preferably, addition of the components is made to the slurry in sequence with the water soluble polymer first and the dispersant second.

The term "carbonaceous materials" as used herein encompasses solid particulate carbonaceous fossil fuel materials which are crushed and milled to obtain finely divided particles suitable for use in pumpable water slurries. Generally, these materials are powdered or pulverized to a size where at least 80% will pass through a 200 mesh screen (U.S. Series). Useful carbonaceous materials include bituminous and anthracite coals, coke, petroleum coke, lignite, charcoal, peat, admixtures thereof and the like.

Water used in the slurry may be taken from any available source such as mine, well, river, or lake water or desalinated ocean water having a sufficiently low mineral salt content such that the electrochemistry of the bound water layer and carrier water interface can be controlled and corrosion of milling facilities, pipelines and furnaces will be minimized and controllable.

The dispersant may be prepared by reacting naphthalene with formaldehyde and sulfuric acid and neutralizing with sodium, lithium, potassium or ammonium hydroxide depending upon the desired cation. Useful processes are described in U.S. Pat. No. 2,141,569—Tucker et al—Dec. 27, 1938; U.S. Pat. No. 3,193,575—Nebel et al—July 6, 1965 and U.S. Pat. No. 3,277,162—Johnson—Oct. 4, 1966.

Naphthalenesulfonic acid formaldehyde condensate is a mixture of condensation products of naphthalenesulfonic acid and formaldehyde. It can be chromatographed by size exclusion chromatography through a column containing pore sizes which selectively separate molecular volumes according to size. The solvent chosen for the acid in chromatography should minimize solute-packing interaction and solute-solute interaction. The chromatogram gives a true molecular volume profile when the eluents are displayed on a detector-strip chart recorder display. The chromatogram for a sample of the sulfonic acid used in the examples is the same as that for the sodium naphthaleneformaldehyde sulfonate in U.S. Pat. No. 3,954,491—Adrian et al—May 4, 1976, and the two anionic materials are identical. That is, the anionic materials from the sulfonic acid have the same profile as the anionic materials from the sodium naphthaleneformaldehyde sulfonate having lowest elution volumes of from about 61 to about 70% of the total elution volume and equivalent elution volumes of from about 61 to about 70% of the total elution volume. The teachings in U.S. Pat. No. 3,954,491 relating to chromatography are incorporated by reference herein. This chromatographic method was described by Dr. Harold Edelstein in a paper entitled, "Aqueous Gel Permeation Chromatograph of Some Naphthalene Sulfonic Acid Formaldehyde Condensates" presented at the Mini Symposium of the North Jersey Chromatography Group Subsection of the A.C.S. on Mar. 6, 1978 at Hoffman La Roche Auditorium, Clifton N.J.

The water soluble polymers which are useful herein are one or more of the following: gum karaya, mixtures of gum karaya and polyacrylamide and polysaccharide modified with polyacrylate. The latter is also referred to as a slightly cross-linked starch-grafted polyacrylate thickener having the following properties:

Appearance: White fine powder
pH (0.1% aqueous soln.): 6.5–8.5
Moisture content: 10 wt% Max
Viscosity (1% aqueous soln.): 9000–15000 cps. (25° C.; 30 RPM)
Ionic charge: Anionic When polyacrylamide is present with the gum karaya, it can be present in amounts up to about 25% by weight of both. Examples are:

| Component | Solids (% by Wt.) | Viscosity (cps) |
|---|---|---|
| Gum karaya | 16–19 | 19,000–26,000 |
| Gum karaya plus polyacrylamide (Wt. ratio of 1:0.24) | 13–14 | 1,000–2,500 |
| Gum karaya plus polyacrylamide (Wt. ratio of 1:0.14) | 13–14 | 3,000–6,000 |
| Polysaccharide modified with polyacrylate | 90 | 9,000–15,000 |

For a fuller understanding of the nature and advantages of this invention, reference may be made to the following examples. These examples are given merely to illustrate the invention and are not to be construed in a limiting sense.

EVALUATION OF DISPERSANTS FOR AQUEOUS CARBONACEOUS SLURRIES

The following procedure was utilized in the evaluation of the products of the examples in aqueous coal slurries. This is achieved by determining the ability of the products to disperse or suspend coal dust uniformly in water by measuring viscosity and examining the sediment, if formed.

APPARATUS USED 8-oz. paint can
Low shear mechanical mixer with a double blade
Spatula
Stormer viscometer

REAGENTS USED

Water of known record hardness
Coal dust—Reference coal is Pittston Coal, 80% through 200 mesh (U.S. Series). Other types of coal and grind sizes can be substituted.
Stabilizing agent

PROCEDURE

1. A slurry of coal dust in water is prepared as follows. Coal dust is slowly added to water under agitation by a low shear mechanical mixer with a double blade. (Do not use a "Lightnin" high speed mixer). Sides of the container are scraped regularly while mixing. The slurry is agitated for an additional hour to ensure uniformity.

2. Viscosity of the aqueous coal slurry is determined by weighing out 200 gram samples of the slurry into 8 oz. paint cans. A specific quantity of product is added to each under vigorous agitation. All cans are closed tightly to prevent evaporation of water.

3. Each can is opened and each slurry is stirred with a spatula before viscosity measurements are made with a Stormer Viscometer. Weights are adjusted in order to find a reading as close as possible to 30 seconds and the correct weight for a 30-second viscosity is determined. Readings are repeated twice after stirring each time and should not differ by more than 2 seconds. Readings are repeated until consistent and the average of two readings taken.

4. Seconds and weight are converted into krebs units which are then converted to centipoise readings.

In the examples, the improvement over the use of the sodium and ammonium condensates alone is demonstrated.

EXAMPLE I

A coal slurry was prepared comprising 60 parts by weight Pittston coal (80% <200 mesh U.S. Series), 39.915 parts by weight distilled water and 0.085 parts by weight of sodium naphthalenesulfonic acid formaldehyde condensate, introduced as a 34% by weight solution, in a manner described in the test procedure. The appearance of this slurry was thin and uniform.

100 gram portions of the coal slurry were poured into each of three 4 oz. glass jars. Then the stabilizer, gum karaya (solids 16–19% and viscosity final 19,000–26,000 cps.), was added to each jar at levels of 1, 0.5 and 0.25 parts by weight, respectively. The slurries were allowed to stand for 24 hours and then examined. At the 1 part by weight stabilizer level, the top was uniform; however some hard packed sediment appeared at the bottom. Hard packing was assessed by insertion of a glass rod. At the 0.5 part by weight stabilizer level a redispersible sediment existed or, in other words, the sediment could be easily redispersed to a uniform slurry. At the 0.25 part by weight stabilizer level the slurry was uniformly dispersed without a sediment appearing.

EXAMPLE II

A coal slurry was prepared comprising 63 parts by weight Pittston coal (80%<200 mesh U.S. Sieve Series), 36.92 parts by weight distilled water and 0.08 parts by weight sodium naphthalenesulfonic acid formaldehyde condensate, introduced as a 34% by weight solution, in a manner described in the test procedure. The appearance of this slurry was thin and uniform.

200 gram portions of the coal slurry were poured into each of two 4 oz. glass jars. Then the stabilizer, gum karaya (solids 16–19% and viscosity final 19,000–26,000 cps.), was added to each jar at levels of 0.12 and 0.08 parts by weight, respectively. The slurries were allowed to stand. Examination at both levels after 36 hours indicated an easily redispersible slurry with little supernatant liquid.

EXAMPLE III

A coal slurry was prepared comprising 63 parts by weight Pittston coal (80%<200 mesh U.S. Sieve Series), 36.92 parts by weight distilled water and 0.08 part by weight sodium naphthalenesulfonic acid formaldehyde condensate, introduced as a 34% by weight solution, in a manner described in the test procedure. The appearance of this slurry was very thin.

Eight 100 ml. portions of this slurry were placed in stoppered graduate cylinders and aliquots of gum karaya (solids 16–19% and viscosity final 19,000–26,000 cps.) were added to seven. The resulting excess water was measured at 24 and 48 hours intervals. The pertinent data are given in Table A. All sediments were soft after 24 and 48 hours.

TABLE A

Effect of gum karaya concentration on stability of coal/water slurry containing sodium naphthalenesulfonic acid formaldehyde condensate.

| Aliquot No. | Concentration of Gum Karaya % by Wt. of Slurry | Excess Water (ml) 24 hrs. | 48 hrs. |
|---|---|---|---|
| Blank | 0.00 | 5 | 6.3 |
| 1 | 0.0025 | 6 | 10 |
| 2 | 0.005 | 6 | 5 |
| 3 | 0.01 | 6 | 7 |
| 4 | 0.025 | 6 | 7 |
| 5 | 0.05 | 7 | 9 |
| 6 | 0.10 | 5 | 5 |
| 7 | 0.30 | 4 | 7 |

EXAMPLE IV

A coal slurry was prepared comprising 60 parts by weight Pittston coal (80%<200 mesh U.S. Sieve Series), 39.92 parts by weight distilled water and 0.08% by weight ammonium naphthalenesulfonic acid formaldehyde condensate, introduced as a 40% by weight solution, in a manner described in the test procedure. The appearance of the slurry was fluid under stirring, but formed a firmly packed sediment when stationary. This signifies that an excess of ammonium condensate caused the coal to floc out.

100 gram portions of the coal slurry were poured into each of ten 4 oz. glass jars, and three gums, each from a 5% by weight aqueous stock solution, were added at different levels. The three gums were: (A) gum karaya (solids 16–19%, viscosity final 19,000–26,000 cps.), (B) a mixture of gum karaya (80.6% by weight) and polyacrylamide (19.4% by weight), (solids 13–14%, viscosity final 1,000–2,500 cps.) and (C) a mixture of gum karaya (87.6% by weight) and polyacrylamide (12.4% by weight), (solids 13–14%, viscosity final 3,000–6,000 cps.). The results are given in Table B. In Table B, H/P stands for hard pack and S/P stands for soft pack. By hard pack, it is meant that a glass rod is needed to redisperse the sediment. Soft pack means that the sediment can be redispersed by agitation alone.

TABLE B

Stability of Coal/Water Slurries containing Ammonium Naphthalenesulfonic acid formaldehyde condensate

| No. | Stabilizer | % By Wt. | After 24 Hours Excess Water (ml) | Sediment | After 36 Hours Sediment |
|---|---|---|---|---|---|
| Blank | — | 0.0 | 1.2 | 4.6 cm. H/P | |
| 1 | B | 0.1 | 0.8 | 0.8 cm. H/P | H/P |
| 2 | B | 0.2 | 0.5 | None | H/P |
| 3 | B | 0.3 | 0.4 | None | Soft to H/P |
| 4 | C | 0.1 | 0.8 | 0.3 cm. H/P | H/P |
| 5 | C | 0.2 | 0.5 | None | H/P |
| 6 | C | 0.3 | 0.5 | None | S/P |
| 7 | A | 0.1 | 1.1 | 4.8 cm. H/P | |
| 8 | A | 0.2 | 1.1 | H/P | |
| 9 | A | 0.3 | 1.3 | H/P | |

EXAMPLE V

The effect of addition of 0.05% by weight gum karaya based on the weight of the slurry (Solids 16–19% by wt., viscosity final 19,000–26,000 cps.) to ammonium condensate (100% solids) on slurry viscosity is illustrated in Table C. A significant lowering of the ammonium condensate viscosity is apparent. The slurry composition is given below:

| Component | % By Wt. |
|---|---|
| Pittston Coal (80% <200 mesh sieve U.S. Series) | 60 |
| Distilled water | Varies |
| Ammonium condensate | Varies |
| Gum karaya (solids 16–19% by wt.; Viscosity final 19,000–26,000 cps.) | 0.05 |
| | 100 |

TABLE C

Effect of stabilizer upon viscosity of slurry containing ammonium naphthalenesulfonic acid formaldehyde condensate.

| Conc. of Ammonium Condensate (% by Wt.) | Visc. at 25.0° C. (cps.) | Conc. of Ammonium Condensate (% by Wt.) (Plus 0.05% by Wt. Gum Karaya) | Visc. at 25.0° C. (cps.) |
|---|---|---|---|
| 0.00 | 4,700 | 0.00 | 4,700 |
| 0.08 | 630 | 0.08 | 240 |
| 0.17 | 480* | 0.17 | 240 |
| 0.25 | 410 | 0.25 | 230* |
| 0.33 | 350* | 0.33 | 210 |
| 0.41 | 330 | 0.41 | 205* |

TABLE C-continued

Effect of stabilizer upon viscosity of slurry containing ammonium naphthalenesulfonic acid formaldehyde condensate.

| Conc. of Ammonium Condensate (% by Wt.) | Visc. at 25.0° C. (cps.) | Conc. of Ammonium Condensate (% by Wt.) (Plus 0.05% by Wt. Gum Karaya) | Visc. at 25.0° C. (cps.) |
|---|---|---|---|
| 0.59 | 370 | 0.59 | 190 |

*Extrapolated

EXAMPLE VI

The effect of addition of 0.05% by weight gum karaya based on the weight of the slurry (solids 16–19% by wt., viscosity final 19,000–26,000 cps.) and polysaccharide modified with polyacrylate (solids 90% by wt., viscosity final 9,000–15,000 cps.) to ammonium condensate (100% solids) on slurry viscosity is illustrated in Table D. A significant lowering of the ammonium condensate viscosity by each, is apparent. (Note that Column 2 of Table D is repeated from Example V for convenience).

| Component | % By Weight |
|---|---|
| Pittston Coal (80% <200 mesh sieve U.S. Series) | 60 |
| Distilled Water | Varies |
| Ammonium Condensate | Varies |
| Gum Karaya (solids 16–19% by wt.; Viscosity Final 19,000–26,000 cps.) or Polysaccharide modified with Polyacrylate (solids 90% by wt.; Viscosity final 9,000–15,000 cps.) | 0.05 |
| | 100 |

TABLE D

Effect of Stabilizer Upon Viscosity of Slurry Containing Ammonium Naphthalene Sulfonic Acid Formaldehyde Condensate.

| Conc. of Ammonium Condensate (% by Wt.) | Visc. at 25.0° C. (cps.) | Conc. of Ammonium Condensate (% by Wt.) (Plus 0.05% by Wt. Gum Karaya**) | Visc. at 25.0° C. (cps.) | Conc. of Ammonium Condensate (% by Wt.) (Plus 0.05% by Wt. Polysaccharide***) | Visc. at 25.0° C. (cps.) |
|---|---|---|---|---|---|
| 0.00 | 4,700 | 0.00 | 4,700 | 0.00 | 4,700 |
| 0.08 | 630 | 0.10 | 330 | 0.10 | 330 |
| 0.17 | 480* | 0.30 | 280 | 0.30 | 250 |
| 0.25 | 410 | 0.50 | 280 | 0.50 | 260 |
| 0.33 | 350* | 0.75 | 260 | 0.75 | 260 |
| 0.41 | 330 | 1.00 | 260 | 1.00 | 250 |
| 0.59 | 370 | | | | |

*Extrapolated

**Blank run 0.05% by Wt. Gum Karaya by itself; Visc. at 25.0° C., 3063 cps.

***Blank run 0.05% by Wt. Polysaccharide by itself; Visc. at 25.0° C., 3000 cps.

While the invention has been described with reference to certain specific embodiments thereof, it is understood that it is not to be so limited since alterations and changes may be made therein which are within the full intended scope of the appended claims.

What is claimed is:

1. A stabilizer composition for aqueous carbonaceous slurries comprising:

(a) at least one dispersant selected from the group consisting of the sodium, lithium, potassium and ammonium salts of naphthalenesulfonic acid formaldehyde condensate, and (b) at least one water soluble polymer selected from the group consisting of gum karaya, mixtures of gum karaya and polyacrylamide, and polysaccharides modified with polyacrylate.

2. The composition of claim 1 wherein said component (a) is present in an amount from about 8% by weight to about 97% by weight and said component (b) is present in an amount of about 3% by weight to about 92% by weight.

3. The composition of claim 2 wherein said component (a) is the sodium salt of naphthalenesulfonic acid formaldehyde condensate.

4. The composition of claim 2 wherein said component (a) is the ammonium salt of naphthalenesulfonic acid formaldehyde condensate.

5. The composition of claim 2 wherein said component (b) is gum karaya.

6. The composition of claim 2 wherein said component (b) is a mixture of gum karaya and polyacrylamide, said polyacrylamide being present in an amount up to about 25% by weight of both.

7. The composition of claim 6 wherein component (b) is a mixture of about 80.6% by weight of gum karaya and about 19.4% by weight of polyacrylamide.

8. The composition of claim 6 wherein component (b) is a mixture of about 87.6% by weight of polyacrylamide and about 12.4% by weight of gum karaya.

9. The composition of claim 2 wherein said component (b) is polysaccharide modified with polyacrylate.

10. An aqueous carbonaceous slurry having present the stabilizer composition of claim 1 in an amount sufficient to reduce viscosity of the slurry, stabilize the network of carbonaceous material in water and improve pumpability.

11. The slurry of claim 10 wherein said slurry contains coal.

12. The slurry of claim 11 wherein said stabilizer composition is present in an amount of from about 0.01% by weight to about 10.0% by weight of the slurry.

13. The slurry of claim 12 wherein said stabilizer composition is composed of component (a) present in an amount of about 8% by weight to about 97% by weight and component (b) present in an amount of about 3% by weight to about 92% by weight.

14. The composition of claim 13 wherein said component (a) is the sodium salt of naphthalenesulfonic acid formaldehyde condensate.

15. The composition of claim 13 wherein said component (a) is the ammonium salt of naphthalenesulfonic acid formaldehyde condensate.

16. The composition of claim 13 wherein component (b) is gum karaya.

17. The composition of claim 13 wherein component (b) is a mixture of gum karaya and polyacrylamide said polyacrylamide being present in an amount up to about 25% by weight of both.

18. The composition of claim 17 wherein component (b) is a mixture of about 19.4% by weight of polyacrylamide and about 80.6% by weight of gum karaya.

19. The composition of claim 17 wherein component (b) is a mixture of about 12.4% by weight of polyacrylamide and about 87.6% by weight of gum karaya.

20. The composition of claim 13 wherein component (b) is polysaccharide modified with polyacrylate.

21. The process of claim 1 wherein said carbonaceous material is coal.

22. The process of claim 21 wherein said component (b) is first added to said slurry and said component (a) is thereafter added to said slurry.

23. A process for preparing stable aqueous carbonaceous slurries comprising incorporating into said slurry the composition of claim 1 in an amount sufficient to reduce water content of the slurry, stabilize the network of carbonaceous material in water and improve pumpability.

* * * * *